US012007165B2

(12) United States Patent
Chishti

(10) Patent No.: US 12,007,165 B2
(45) Date of Patent: Jun. 11, 2024

(54) OPTIMIZED NATURAL GAS PRODUCTION CONTROL SYSTEM WITH ACTUAL FLOW AND SET POINT TRACKING FEATURES

(71) Applicant: Saudi Arabian Oil Company, Dhahran (SA)

(72) Inventor: Khurram Saeed Chishti, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 573 days.

(21) Appl. No.: 17/340,732

(22) Filed: Jun. 7, 2021

(65) Prior Publication Data

US 2022/0390170 A1 Dec. 8, 2022

(51) Int. Cl.
*F25J 1/02* (2006.01)
*F25J 1/00* (2006.01)

(52) U.S. Cl.
CPC ..... *F25J 1/0022* (2013.01); *F25J 1/0252* (2013.01); *F25J 1/0283* (2013.01); *F25J 1/0298* (2013.01); *F25J 2210/62* (2013.01); *F25J 2215/60* (2013.01); *F25J 2280/50* (2013.01); *F25J 2290/10* (2013.01)

(58) Field of Classification Search
CPC ..... F25J 1/0022; F25J 1/0283; F25J 1/0298; F25J 1/0252; F25J 2210/62; F25J 2215/60; F25J 2290/10; F25B 2400/0411
See application file for complete search history.

(56) References Cited

U.S. PATENT DOCUMENTS 4,456,459 A * 6/1984 Brundige, Jr. ..... F25J 1/0248 62/613
6,220,052 B1 4/2001 Tate, Jr. et al.
2010/0326133 A1 12/2010 Beeby et al.
2019/0011179 A1* 1/2019 Tezuka ..... F25J 1/0254
2019/0285339 A1* 9/2019 Sakamoto ..... F25J 1/0005
2020/0003070 A1* 1/2020 Yamazoe ..... F25J 1/005

FOREIGN PATENT DOCUMENTS

CN 1615415 A 5/2005
CN 111592441 A 8/2020

OTHER PUBLICATIONS

Chishti, Uthmaniyah Gas Plant Department, EDRF-K-0003A/B TEx Commissioning Report, Aug. 1, 2020.
Jacobson et al, "Enhanced Control Techniques for Cryogenic Turboexpander Recompressors", Expertise in Turbomachinery Controls, Feb. 1, 2014.

* cited by examiner

*Primary Examiner* — Brian M King
(74) *Attorney, Agent, or Firm* — DINSMORE & SHOHL LLP

(57) ABSTRACT

Systems and methods for controlling a natural gas production system in an upset scenario, and/or during startup of turbo-expander system are disclosed. In one embodiment, a method of operating a Joule-Thomson valve of a natural gas production system includes determining an upset event within the natural gas production system, obtaining a flow rate through at least one expander prior to the upset event, and calculating, based on the flow rate, a percent opening of the Joule-Thomson valve. The method further includes opening the Joule-Thomson valve to the percent opening, controlling the Joule-Thomson valve by a PID controller in a set point tracking mode for a period of time, and controlling the Joule-Thomson valve by the PID controller in an automatic mode.

20 Claims, 7 Drawing Sheets

OPTIMIZED NATURAL GAS PRODUCTION CONTROL SYSTEM WITH ACTUAL FLOW AND SET POINT TRACKING FEATURES

BACKGROUND

Natural gas processing systems may utilize Joule-Thomson valves and turbo-expanders in the separation of natural gas from heavier hydrocarbon gases include but not limited to ethane, propane, butane, and pentane and are commonly called Natural Gas Liquids (NGL). Turbo-expanders are used to cool the dry inlet feed prior to entering a demethanizer column. Residue gas from the top of the column is passed through series of cold boxes before being compressed by the compressor portion of the turbo-expanders. Turbo-expanders and recompressors are connected to the same shaft. A Joule-Thomson (JT) valve(s) is used to bypass the flow around the turbo-expanders when the expanders are offline or in trip state. Joule-Thomson valves are also used during the startup of the train. The main objective of the NGL processing is to maximize the NGL recovery which can only be achieved when the turbo-expanders are in operation. The main difference between the expander and Joule-Thomson mode of operation is the amount of NGL recovery. In Joule-Thomson mode the recovery is around 65% to 80% whereas in expander mode, more than 97% of recovery can be achieved based on the operating conditions.

In order to achieve the NGL processing train objective, transitioning from Joule-Thomson valve operations to turbo-expander mode of operation and vice versa is one of the important operating modes that should have tight control to ensure minimum process variations downstream in column pressure and upstream in plant inlet flow. Further, upset scenarios in the natural gas processing system can cause further tripping of downstream components, such as sales gas compressors. For example, when a turbo-expander trips, the flow through the expander cuts instantly. Since traditional master controllers are pressure based, such master controllers do not anticipate a sudden cut of flow due to the quick closing valve on the expander. This leads to slow opening of the Joule-Thomson valve to compensate for the lost flow. However, by the time the Joule-Thomson valve opens and compensates for the lost flow, the pressure may drop significantly downstream, resulting in tripping of other components, such as sales gas compressors.

Accordingly, alternative systems and methods for controlling natural gas processing systems that account for upset scenarios are desired.

SUMMARY

Embodiments of the present disclosure are directed to systems and methods for controlling natural gas production systems in the event of an upset scenario. Embodiments of the present disclosure are directed to systems and methods that control the Joule-Thomson valve such that it opens to a percent-opening immediately after an upset event to compensate for the flow loss due to the upset event. The PID controller that controls the Joule-Thomson valve is then entered into a set point tracking mode for a period of time. Following the period of time, the set point ramps back up to a pre-trip value at a ramp rate and the PID controller is set to an automatic mode (i.e., normal mode). This control methodology provides tight and precise control of the Joule-Thomson valve, and avoids nuisance trips of downstream equipment due to considerable pressure drop.

In one embodiment, a method of operating a Joule-Thomson valve of a natural gas production system includes determining an upset event within the natural gas production system, obtaining a flow rate through at least one expander prior to the upset event, and calculating, based on the flow rate, a percent opening of the Joule-Thomson valve. The method further includes opening the Joule-Thomson valve to the percent opening, controlling the Joule-Thomson valve by a PID controller in a set point tracking mode for a period of time, and controlling the Joule-Thomson valve by the PID controller in an automatic mode after the period of time.

In another embodiment, a natural gas production system includes a Joule-Thomson valve, at least one expander, one or more processors, and a non-transitory computer-readable medium storing instructions. The instructions, when executed by the one or more processors causes the one or more processors to receive an upset event signal corresponding to an upset event within the natural gas production system, obtain a flow rate through the at least one expander prior to the upset event, and calculate, based on the flow rate, a percent opening of the Joule-Thomson valve. The instructions also cause the one or more processors to provide a first control signal to the Joule-Thomson valve to open the Joule-Thomson valve to the percent opening, provide a second control signal to the Joule-Thomson valve to control the Joule-Thomson valve by a PID controller in a set point tracking mode for a period of time, and provide a third control signal to the Joule-Thomson valve to control the Joule-Thomson valve by the PID controller in an automatic mode after the period of time.

In yet another embodiment, a system for controlling a natural gas facility includes one or more processors, and a non-transitory computer-readable medium storing instructions. The instructions, when executed by the one or more processors causes the one or more processors to receive an upset event signal corresponding to an upset event within the natural gas production system, obtain a flow rate through the at least one expander prior to the upset event, and calculate, based on the flow rate, a percent opening of the Joule-Thomson valve. The instructions also cause the one or more processors to provide a first control signal to the Joule-Thomson valve to open the Joule-Thomson valve to the percent opening, provide a second control signal to the Joule-Thomson valve to control the Joule-Thomson valve by a PID controller in a set point tracking mode for a period of time, and provide a third control signal to the Joule-Thomson valve to control the Joule-Thomson valve by the PID controller in an automatic mode after the period of time.

It is to be understood that both the foregoing general description and the following detailed description present embodiments that are intended to provide an overview or framework for understanding the nature and character of the claims. The accompanying drawings are included to provide a further understanding of the disclosure, and are incorporated into and constitute a part of this specification. The drawings illustrate various embodiments and together with the description serve to explain the principles and operation.

DETAILED DESCRIPTION

Embodiments of the present disclosure are directed to natural gas production systems (also referred to herein as natural gas facilities) and methods for controlling natural gas production systems, particularly in the event of an upset scenario. In the event of an upset (e.g., an expander trips), the flow though the expander will immediately drop to zero until a Joule-Thomson valve can open and restore flow. The Joule-Thomson valve controller, which may be a proportional-integral-derivative (PID) controller, for example, would immediately see the loss of flow and rapidly open the Joule-Thomson valve because the tuning of the flow controller of the system can be much faster than the pressure controller without jeopardizing the steady state plant stability.

Generally, embodiments of the present disclosure control the Joule-Thomson valve such that it opens to a calculated, optimal percent-opening immediately after an upset event to compensate for the flow loss due to the upset event. The PID controller that controls the Joule-Thomson valve is then entered into a set point tracking mode for a period of time. Following the period of time, the set point ramps back up to a pre-trip value at a ramp rate and the PID controller is set to an automatic mode (i.e., normal mode). This control methodology provides tight and precise control of the Joule-Thomson valve, and avoids nuisance trips of downstream equipment due to considerable pressure drop.

Embodiments of the systems and methods are described in detail below.

Figure 1:
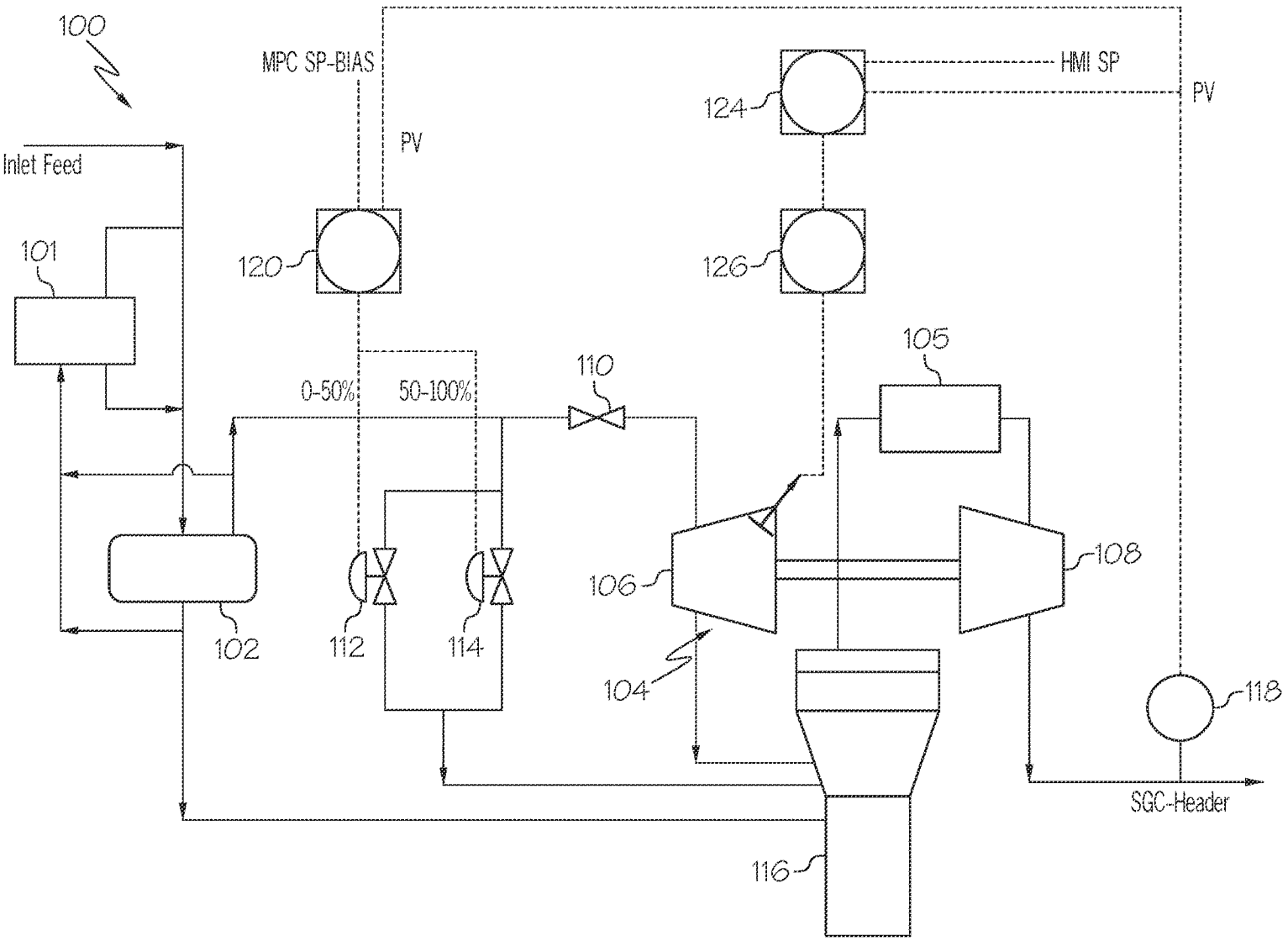
FIG. 1 schematically illustrates an example natural gas production system according to one or more embodiments described and illustrated herein.

Referring now to FIG. 1, an example portion of a natural gas production system 100 is schematically illustrated. It should be understood that the natural gas production system 100 shown in FIG. 1 is for illustrative purposes only, and that embodiments are not limited to the natural gas production system 100 shown in FIG. 1. For example, the natural gas production system 100 may include additional components, fewer components, or differently arranged components that what is shown in FIG. 1.

In the illustrated example, the example natural gas production system 100 includes a gas-liquid separator 102, a turbo-expander/recompressor system 104, and a de-methanizer column 116. Dry cooled natural gas enters the gas-liquid separator 102, which is configured to separate liquid of the natural gas from the gas. The gas stream from the gas-liquid separator is split into two streams: one stream is provided to the expander 106 of the turbo-expander/recompressor system 104 (e.g., through valve 110), and the other stream is provided to cold boxes 101 for exchange purposes before it enters to de-methanizer column 116. The gas stream is expanded by the expander that lowers the pressure and temperature of the gas stream. The cooled gas stream is then provided to the de-methanizer column 116.

The liquid stream from the gas-liquid separator 102 is split into two streams: one stream is mixed with the gas stream from the gas-liquid separator 102 which goes to cold boxes for exchange purposes. The other liquid stream from the gas-liquid separator 102 is fed directly to de-methanizer column 116.

The system 100 further includes a first Joule-Thomson valve 112 that is utilized in a Joule-Thomson mode of operation that by-passes the turbo-expander/recommpressor system 104. It is noted that a second Joule-Thomson valve 114 is illustrated to show that more than one Joule-Thomson valve may be provided in some embodiments. The first and second Joule-Thomson valves 112, 114 may be operated in any configuration. In this particular example they are operated in parallel configuration.

As is known in the art, the de-methanizer 116 produces residue gas from the top which is used by cold boxes 105 for heat exchange purposes before it is provided to the recompressor 108 of the turbo-expander/recompressor system 104, which compresses the residue gas product that is then provided to a sales gas distribution header (i.e., a residue gas header).

In the illustrated example, master controller 124, which is a PID controller, controls the overall downstream pressure of the system 100 by manipulating the expander guide vanes of the expander 106. Downstream pressure 118 of the discharge of recompressor 108, which is a representation of the residue gas header pressure, is used as a process variable PV to the master controller 124. The Joule-Thomson valve is controlled by controller 120, which is a PID controller having a set point MPC SP-BIAS which is biased by the master controller 124 set point (HMI SP). This bias value is operator selectable. The process variable PV to the Joule-Thomson valves controller 120 is same as the PV to the master controller 124. The output of the controller 120 in the illustrated embodiment is split between 0-50% and 50-100%. The 0-50% split is used to control the first Joule-Thomson valve 112 whereas 50-100% split is used to control the second Joule-Thomson valve 114. In some embodiments, a load sharing controller 126 is provided to ensure both turbo-expanders distribute total plant load equally to avoid flow and power imbalances. It should be understood that embodiments are not limited by the controller configuration illustrated by FIG. 1, and that other controllers and controller configurations are possible.

When an upset event occurs, such as when the expander 106 trips, gas flow through the expander 106 ceases immediately, which causes the overall pressure of the system 100 to quickly drop. Because the master controller 124 is pressure-control based, it is not accustomed to a sudden lack of flow through the expander 106. Therefore, this leads to slow opening of the Joule-Thomson valve to compensate for the lack of flow through the expander 106. This may cause downstream components to also trip, such as sales gas compressors, for example.

Figure 2:
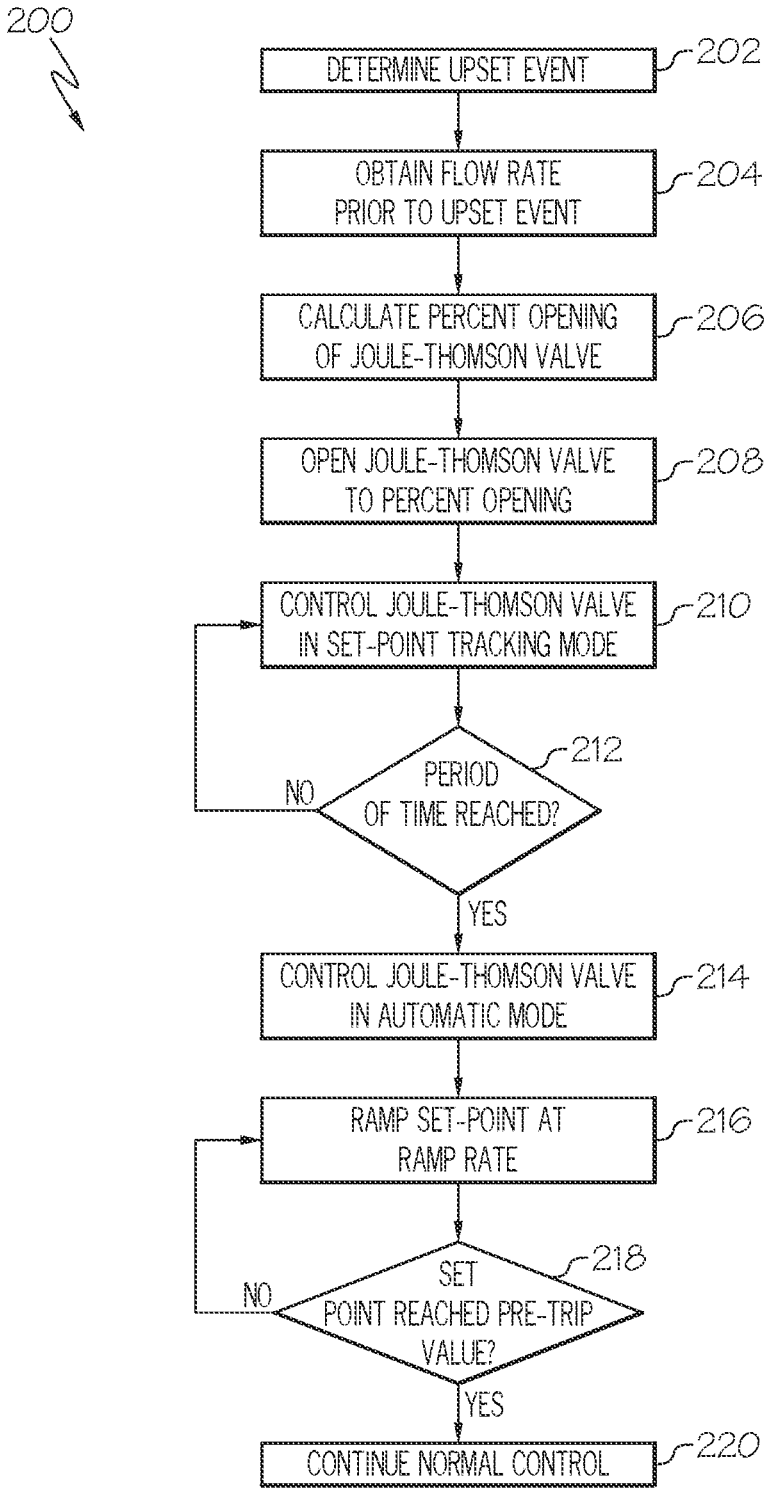
FIG. 2 is a flowchart showing an example method for controlling a natural gas production system according to one or more embodiments described and illustrated herein.

Referring now to FIG. 2, a flowchart 200 illustrating a non-limiting example method of controlling a Joule-Thomson valve and therefore controlling a natural gas processing system is shown. It should be understood that embodiments are not limited by the number and order of steps illustrated by FIG. 2. At block 202, an upset event is determined. For example, the expander 106 of the turbo-expander 104 may trip, thereby preventing gas from flowing through the expander 106 to the de-methanizer 116. The upset event may be detected in a variety of ways. In one non-limiting example, the expander 106 includes a sensor that detects the trip event, and sends a signal to a controller or other computing device that operates the controllers of the system, such as controller 120 and/or controller 124.

Next, at block 204, the flow rate through the expander 106 just prior to the upset event is obtained. The expander 106 may include one or more flow measuring instruments that periodically records the amount of gas flowing through the expander 106. The last flow measurement is obtained and used in block 206.

Figure 3A:
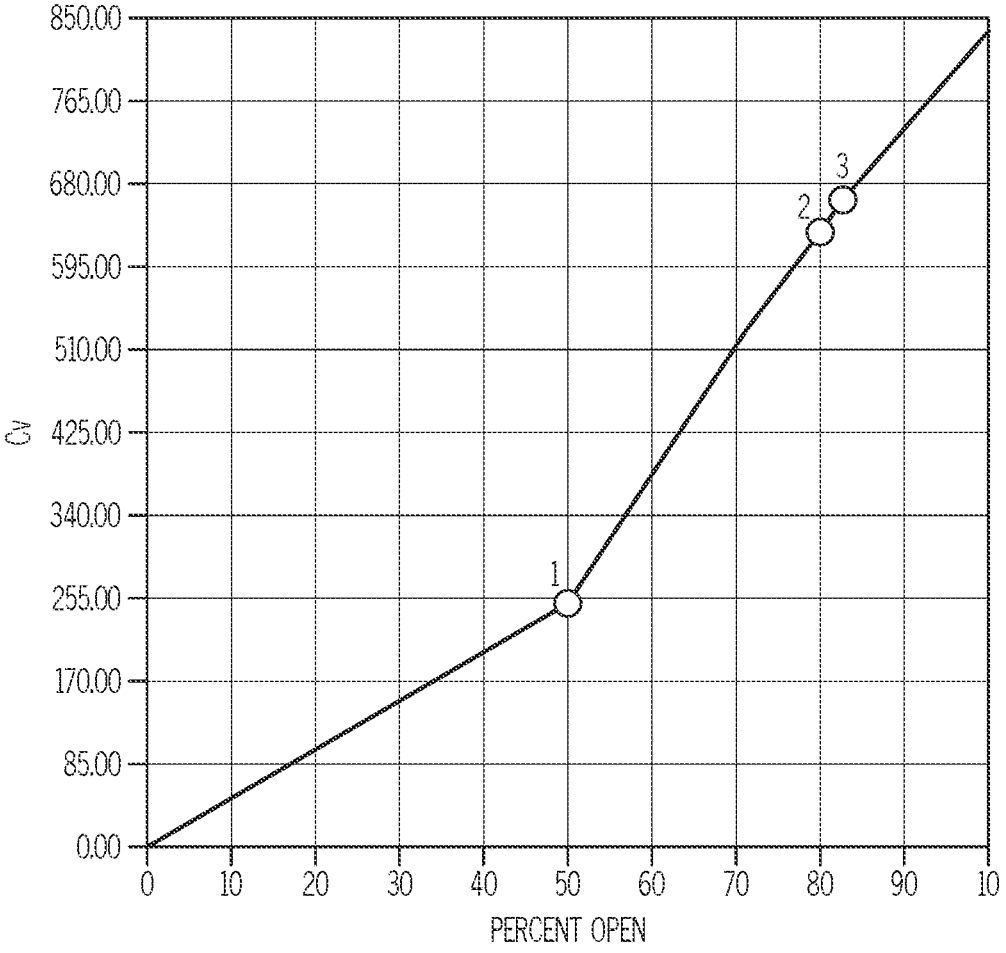
FIG. 3A is a flow versus percent opening of an example Joule-Thomson valve according to one or more embodiments described and illustrated herein.
Figure 3B:
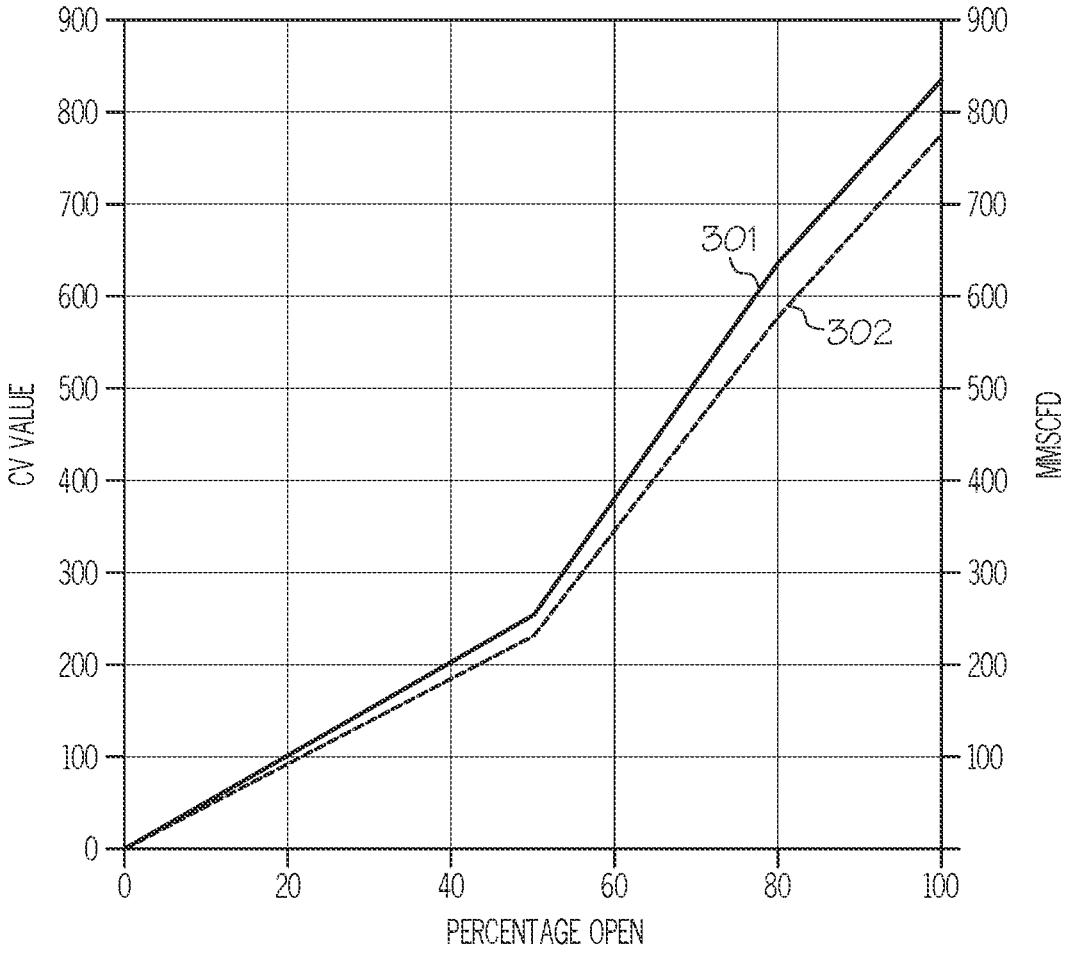
FIG. 3B is a flow versus percent opening of an example Joule-Thomson valve in Cv and MMSCFD according to one or more embodiments described and illustrated herein.

At block 206 a percent-opening of the Joule-Thomson valve 112 to compensate for the lost flow through the expander 106 is calculated. The last flow measurement that is obtained in block 204 is used to determine the amount of flow through the expander 106 that should be compensated for by the Joule-Thomson valves 112/114. A percent-opening algorithm is used to calculate the percent-opening of the Joule-Thomson valves 112/114. The percent-opening algorithm is based on the Joule-Thomson valve flow (Cv)-percent opening curve, which may be derived from the datasheet provided by the valve manufacture. As a non-limiting example, three data points are available from a valve datasheet provided by a manufacture: 0% open, 50% open, and 80% open. A curve is extrapolated from these data points, as shown in FIG. 3B. FIG. 3B additionally shows a first plot 301 wherein the y-axis is the flow coefficient Cv (in gallons) and a second plot 302 wherein the y-axis is million standard cubic feet per day (MMSCFD). An equation may be fit to either one of the plots and used by the percent-opening algorithm to calculate for a percent-opening of the Joule-Thomson valves 112/114. In some embodiments, additional points beyond the points provided by the datasheet may be experimentally determined to provide a more accurate flow-percent opening curve.

After calculating the percent-opening of the Joule-Thomson valves 112/114 to compensate for the lost flow through the expander 106, the Joule-Thomson valves 112/114 are controlled to open to the calculated percent-opening at block 208. For example, the Joule-Thomson valve receives a control signal to open to the calculated percent-opening. At block 210, controller 120 is placed into set point tracking mode (e.g., by a control signal), meaning that the PID control of the controller 120 is set such that the set point is equal to the measured process valve PV (i.e., the measured flow at the gas residue header as illustrated by element 118). Thus, the set point tracks the measured process value.

As stated above, the immediate opening of the Joule-Thomson valves 112/114, in case of a trip of the expander 106, will compensate for the sudden loss of flow (due to a quick closing valve 110, within a second, at the suction of the expander 106) almost immediately. The Joule-Thomson controller 120, which is a conventional PID control, would lack the agility required to compensate for the sudden loss of flow irrespective of how good the PID controller is tuned. The set point tracking feature ensures that there is no gap between the process variable and the set point of the PID control of controller 120 when the normal PID control resumes after the upset event. With aggressive tuning parameters (high gain), the more the gap between the two, the larger the output kick to the Joule-Thomson valve 112. Together both of these features assist to minimize the interruption of the upset event, minimizes process parameters fluctuation in the de-methanizer column, and keep the natural gas liquid (NGL) production within specification. In addition, quick recovery of the loss of flow ensures the downstream equipment (e.g., sales gas compressors) continues to operate and produce into the Master Gas System (MGS) without interrupting the gas demand of the region served.

The Joule-Thomson valves 112/114 are controlled in set point tracking mode for a period of time, as shown by block 212. Embodiments are not limited to any particular period of time. The period of time may be established experimentally, for example. As a non-limiting example, the period of time may be within a range of fifteen seconds and ninety seconds, including end points. As a further non-limiting example, the period of time may be thirty seconds. The process continues from block 212 back to block 210 such that set point tracking maintained.

When the period of time is reached at block 212, the process moves to block 214, where set point tracking mode of controller 120 is turned off and automatic mode (i.e., normal PID mode) is turned on. Therefore, the Joule-Thomson valves 112/114 are controlled in automatic PID mode by controller 120.

At block 216, the set point of controller 120 is increased (i.e., ramped) at a ramp rate. The process moves to block 218 where it is determined if the pre-trip value of the set point is reached. The pre-trip value is the value of the set point immediately before the upset event. If the pre-trip value has not been met, the process moves back to block 216 where the set point value is further increased. It is noticed that if no ramp rate is used, there may be a jump to a set point which will trigger erroneous system response due to aggressive tuning parameters. To avoid this behavior, the pre-defined ramp rate slowly ramps the set point back to its pre-trip state. By slowly ramping the set point, the PID control response is smooth and there is no overshoot or undershoot. The pre-defined ramp rate is not limited by this disclosure and may be experimentally obtained.

When the set point value reaches the pre-trip value, the process continues to block 220 where the process continues normal control.

Figure 4A:
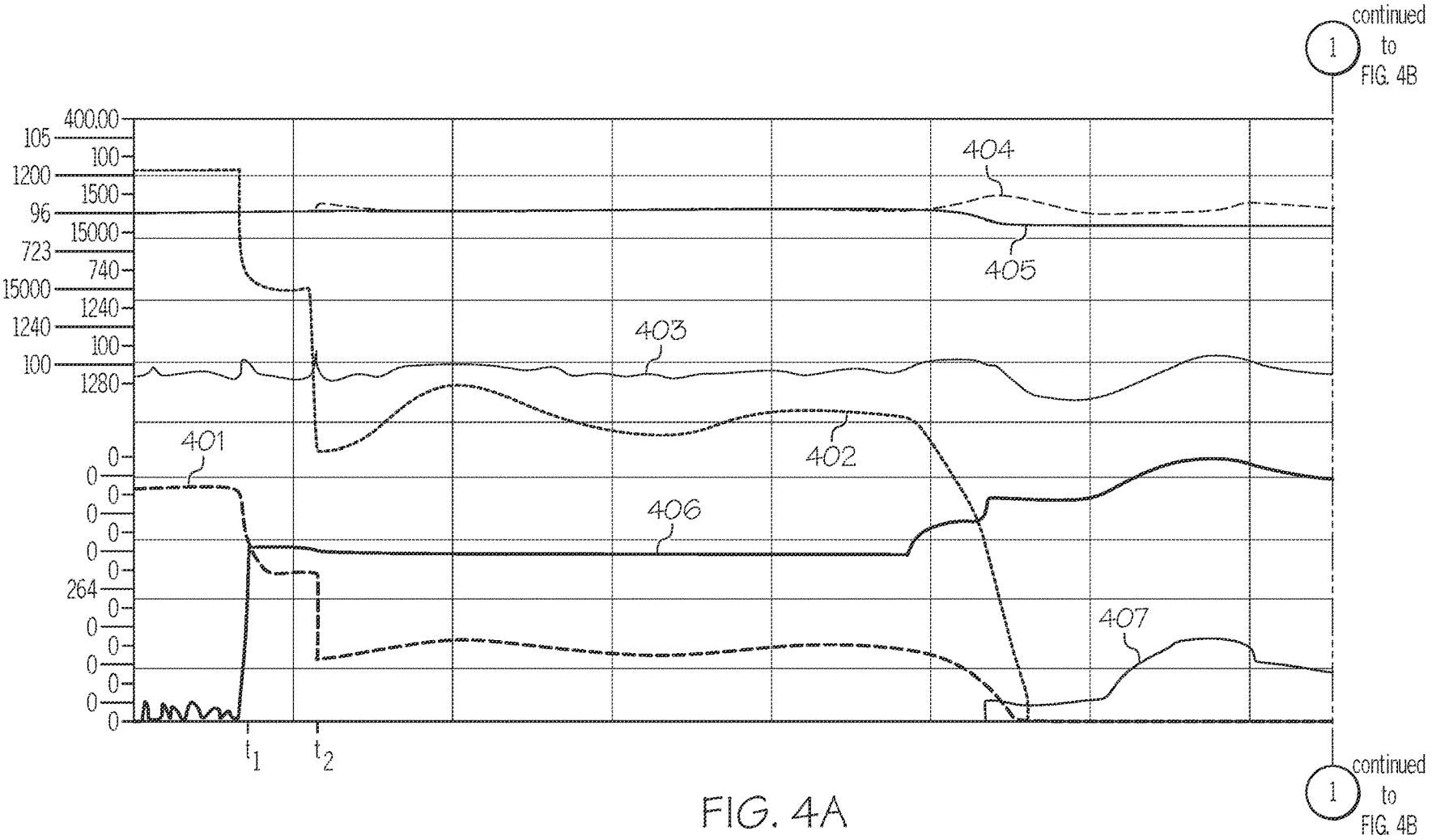
FIGS. 4A and 4B illustrate plots of the outputs of components of a natural gas production system controlled by the methods of the present disclosure according to one or more embodiments described and illustrated herein.
Figure 4B:
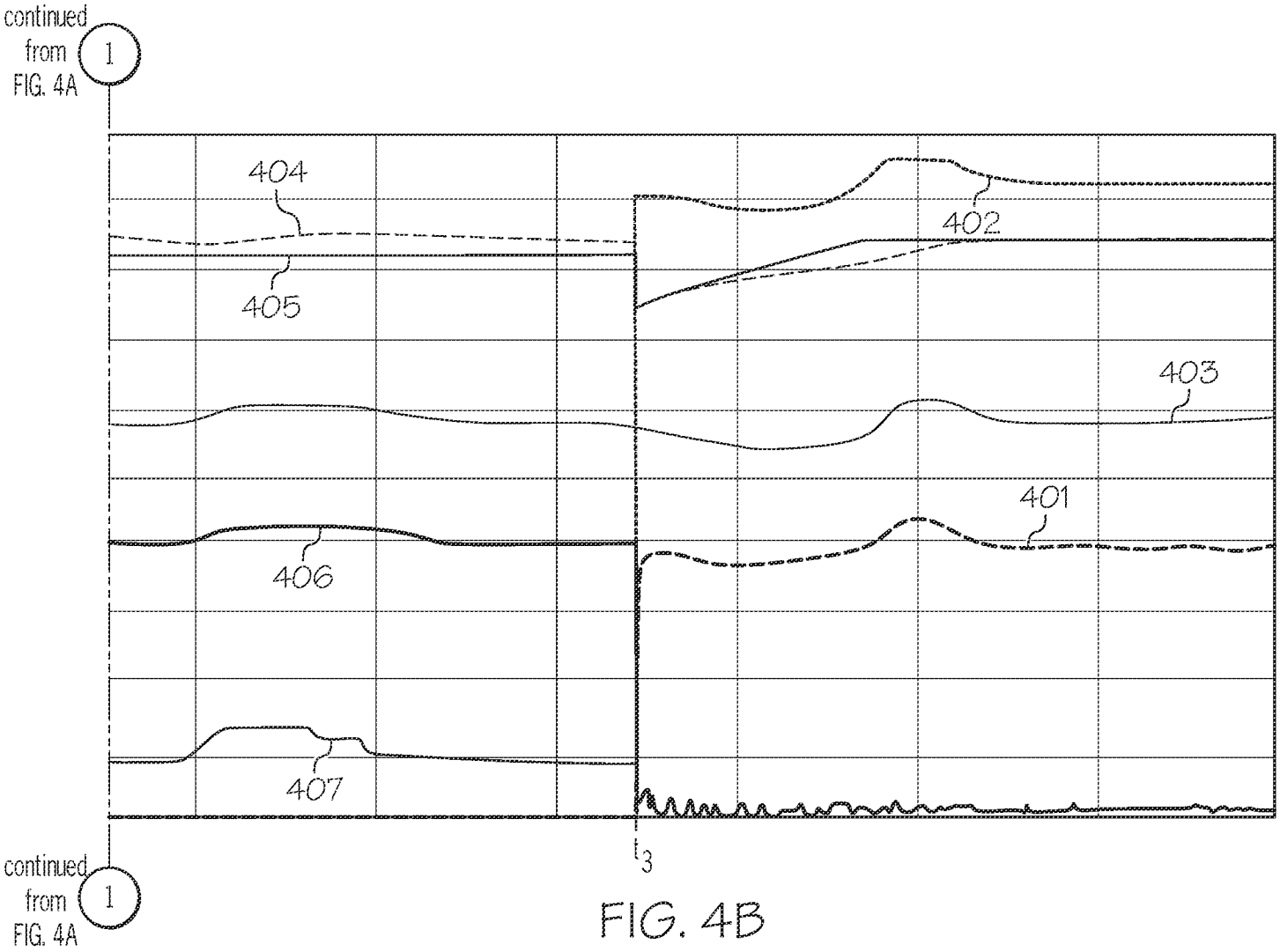

Several experiments were run to evaluate the control method illustrated by FIG. 2. In one experiment, an emergency shut down (ESD) test was performed by shutting down expanders of two turbo-expanders/recompressor system. The plots of FIGS. 4A and 4B illustrate outputs of the system in response to events of the test. The first turbo-expander was started at time $t_1$, and the Joule-Thomson valve was pre-positioned in a close direction (plot 402) equivalent to gas flow received by the expander of the first turbo-expander (plot 407). The second turbo-expander was started at time $t_2$, and a Joule-Thomson valve was pre-positioned in a close direction (plot 402) equivalent to gas flow received by the expander (plot 406). The overall system flow is shown by plot 403 and was not in overshoot.

The expanders were put into emergency shut down at time $t_3$. The percent-opening of the Joule-Thomson to compensate for loss of flow through the expander was calculated as described above with respect to block 206 of FIG. 2 to be 88% opened. The 88% open value provided equivalent to both expanders flow of 601 MMSCFD (plots 407 and 406). The Joule-Thomson valve was put into set point tracking mode with the master pressure (plot 405 (set point to the master controller) and plot 404 (actual pressure)) for a thirty second period of time. After the thirty seconds, the set point tracking mode was disabled and the set point was allowed to ramp up to its pre-trip state prior to resuming normal Joule-Thomson valve control. The inlet unit flow (plot 403) did not overshoot at all and the Joule-Thomson valve did not open more than the expected value of 88%.

Figure 5:
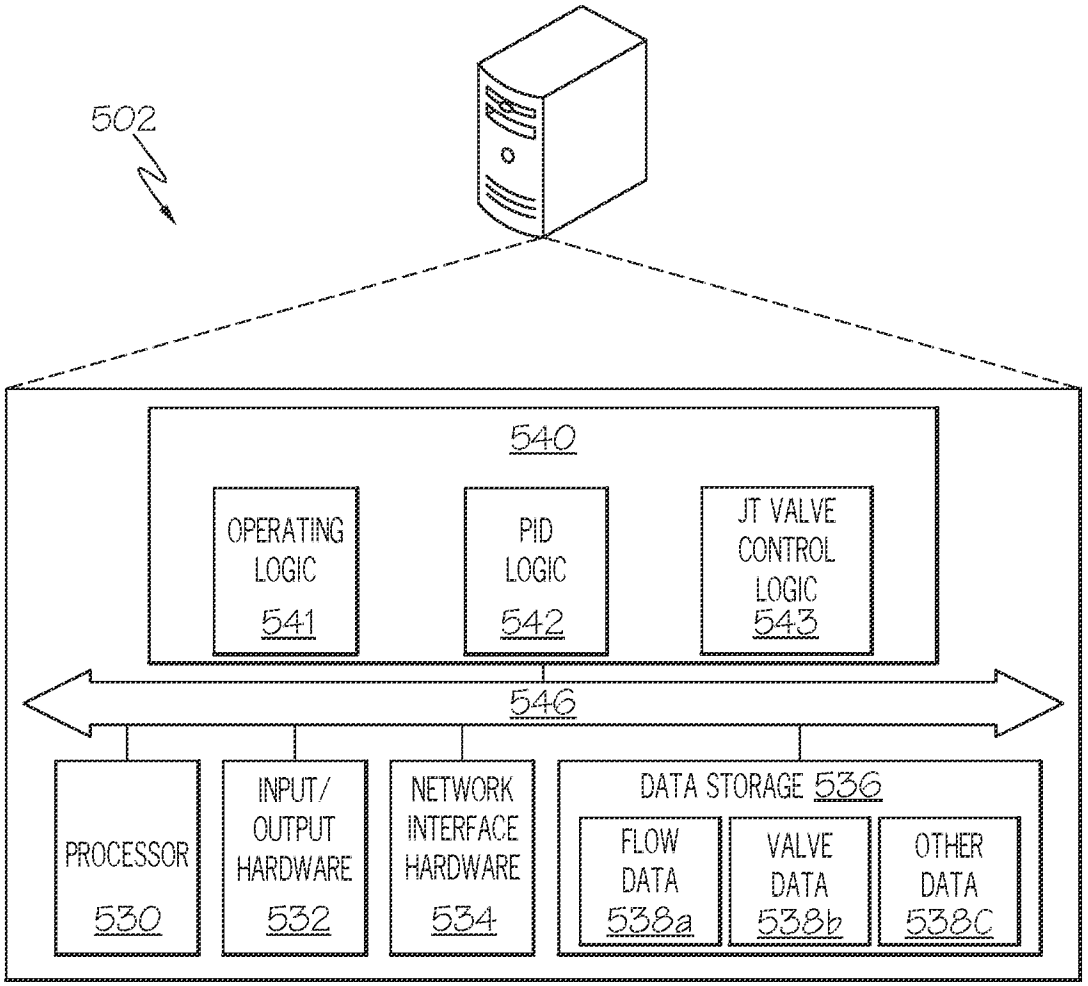
FIG. 5 is an example computer system for performing the functionalities of the present disclosure according to one or more embodiments described and illustrated herein.

Embodiments of the present disclosure may be implemented by a computing device, and may be embodied as computer-readable instructions stored on a non-transitory memory device. FIG. 5 depicts an example computing device 500 configured to perform the functionalities described herein. The example computing device 500 provides a system for operating a natural gas production system, and/or a non-transitory computer-usable medium having computer readable program code for operating a natural gas production system embodied as hardware, software, and/or firmware, according to embodiments shown and described herein. While in some embodiments, the computing device 500 may be configured as a general purpose computer with the requisite hardware, software, and/or firmware. In some embodiments, the computing device 500 may be configured as a special purpose computer designed specifically for performing the functionalities described herein. It should be understood that the software, hardware, and/or firmware components depicted in FIG. 5 may also be provided in other computing devices external to the computing device 500 (e.g., data storage devices, remote server computing devices, and the like).

As also illustrated in FIG. 5, the computing device 500 (or other additional computing devices) may include a processor 530, input/output hardware 532, network interface hardware 534, a data storage component 536 (which may include flow data 538A, valve data 538B, and any other data 538C), and a non-transitory memory component 540. The memory component 540 may be configured as volatile and/or non-volatile computer readable medium and, as such, may include random access memory (including SRAM, DRAM, and/or other types of random access memory), flash memory, registers, compact discs (CD), digital versatile discs (DVD), and/or other types of storage components. Additionally, the memory component 540 may be configured to store operating logic 541, PID logic 542, and Joule-Thomson valve control logic 543 (each of which may be embodied as computer readable program code, firmware, or hardware, as an example). A local interface 546 is also included in FIG. 5 and may be implemented as a bus or other interface to facilitate communication among the components of the computing device 500.

The processor 530 may include any processing component configured to receive and execute computer readable code instructions (such as from the data storage component 536 and/or memory component 540). The input/output hardware 532 may include an electronic display device, keyboard, mouse, printer, camera, microphone, speaker, touch-screen, and/or other device for receiving, sending, and/or presenting data. The network interface hardware 534 may include any wired or wireless networking hardware, such as a modem, LAN port, wireless fidelity (Wi-Fi) card, WiMax card, mobile communications hardware, and/or other hardware for communicating with other networks and/or devices, such as external devices for operating well components (e.g., valves).

It should be understood that the data storage component 536 may reside local to and/or remote from the computing device 500, and may be configured to store one or more pieces of data for access by the computing device 500 and/or other components. As illustrated in FIG. 5, the data storage component 536 may include flow data 538A, which in at least one embodiment includes flow measures through an expander of a turbo-expander. Similarly, valve data 538B may be stored by the data storage component 536 and may include an equation relating to a particular Joule-Thomson valve for calculating a percent-open value for compensating for an upset event. Other data 538C to perform the functionalities described herein may also be stored in the data storage component 536.

Included in the memory component 540 may be the operating logic 541, PID logic 542, and Joule-Thomson valve control logic 643. The operating logic 541 may include an operating system and/or other software for managing components of the computing device 500. Similarly, PID logic 542 may reside in the memory component 540 (or some other remote computing device) and is configured to perform PID control functionalities of one or more system components, such as Joule-Thomson valves and turbo-expanders. It is noted that the PID logic 542 may be stored in the computing device 500, or in the respective controllers themselves. Joule-Thomson valve control logic 543 is configured to calculate the percent-open value to compensate for lost flow through the expander during an upset event.

It should now be understood that embodiments of the present disclosure are directed to systems and methods for controlling a Joule-Thomson valve during an upset event, such as the tripping of an expander of a turbo-expander, and/or during startup of turbo-expander system. The embodiments of the present disclosure control the Joule-Thomson valve such that a loss of pressure within the natural gas processing system is prevented, thereby preventing the tripping of downstream components, such as sales gas compressors. Particularly, embodiments of the present disclosure control the Joule-Thomson valve such that it opens to percent-opening immediately after an upset event to compensate for the flow loss due to the upset event. The PID controller that controls the Joule-Thomson valve is then entered into a set point tracking mode for a period of time. Following the period of time, the set point ramps back up to a pre-trip value at a ramp rate and the PID controller is set to an automatic mode (i.e., normal mode). This control methodology provides tight and precise control of the Joule-Thomson valve, and avoids nuisance trips of downstream equipment due to considerable pressure drop.

In a first aspect, a method of operating a Joule-Thomson valve of a natural gas production system comprises determining an upset event within the natural gas production system, obtaining a flow rate through at least one expander prior to the upset event, and calculating, based on the flow rate, a percent opening of the Joule-Thomson valve. The method further includes opening the Joule-Thomson valve to the percent opening, controlling the Joule-Thomson valve by a PID controller in a set point tracking mode for a period of time, and controlling the Joule-Thomson valve by the PID controller in an automatic mode.

In a second aspect, a method according to the first aspect, wherein the period of time is within a range of fifteen seconds and ninety seconds, including endpoints.

In a third aspect, a method according to the first aspect or the second aspect, further comprising ramping a set point of the PID controller to a pre-trip value at a ramp-rate after the period of time.

In a fourth aspect, a method according to any preceding aspect, wherein the upset event is an expander trip.

In a fifth aspect, a method according to any preceding aspect, wherein the percent opening of the Joule-Thomson valve is further based on a flow-percent open curve.

In a sixth aspect, a method according to any preceding aspect, wherein the percent opening of the Joule-Thomson valve is a function of gas flow through the at least one expander prior to the upset event.

In a seventh aspect, a method according to any preceding aspect, wherein the Joule-Thomson valve compensates for a loss of flow through the at least one expander following the upset event.

In an eighth aspect, a natural gas production system comprises a Joule-Thomson valve, at least one expander, one or more processors, and a non-transitory computer-readable medium. The non-transitory computer-readable medium stores instructions that, when executed by the one or more processors causes the one or more processors to receive an upset event signal corresponding to an upset event within the natural gas production system, obtain a flow rate through the at least one expander prior to the upset event, and calculate, based on the flow rate, a percent opening of the Joule-Thomson valve. The instructions further cause the one or more processors to provide a first control signal to the Joule-Thomson valve to open the Joule-Thomson valve to the percent opening, provide a second control signal to the Joule-Thomson valve to control the Joule-Thomson valve by a PID controller in a set point tracking mode for a period of time, and provide a third control signal to the Joule-Thomson valve to control the Joule-Thomson valve by the PID controller in an automatic mode.

In a ninth aspect, a system according to the eighth aspect, wherein the period of time is within a range of fifteen seconds and ninety seconds, including endpoints.

In a tenth aspect, a system according the eighth or ninth aspect, wherein the instructions further cause the one or more processors to ramp a set point of the PID controller to a pre-trip value at a ramp-rate after the period of time.

In an eleventh aspect, a system according to any one of the eighth through tenth aspects, wherein the upset event is an expander trip.

In a twelfth aspect, a system according to any one of the eighth through eleventh aspects, wherein the percent opening of the Joule-Thomson valve is further based on a flow-percent open curve.

In a thirteenth aspect, a system according to any one of the eighth through twelfth aspects, wherein the percent opening of the Joule-Thomson valve is a function of gas flow through the at least one expander prior to the upset event.

In a fourteenth aspect, a system according to any one of the eighth through thirteenth aspects, wherein the Joule-Thomson valve compensates for a loss of flow through the at least one expander following the upset event.

In a fifteenth aspect, a system for controlling a natural gas facility comprises one or more processors, and a non-transitory computer-readable medium storing instructions that, when executed by the one or more processors causes the one or more processors to receive an upset event signal corresponding to an upset event within the natural gas production system, obtain a flow rate through at least one expander prior to the upset event, and calculate, based on the flow rate, a percent opening of a Joule-Thomson valve. The instructions further cause the one or more processors to provide a first control signal to the Joule-Thomson valve to open the Joule-Thomson valve to the percent opening, provide a second control signal to the Joule-Thomson valve to control the Joule-Thomson valve by a PID controller in a set point tracking mode for a period of time, and provide a third control signal to the Joule-Thomson valve to control the Joule-Thomson valve by the PID controller in an automatic mode.

In a sixteenth aspect, a system according to the fifteenth aspect, wherein the period of time is within a range of fifteen seconds and ninety seconds, including endpoints.

In a seventeenth aspect, a system according to the fifteenth aspect or the sixteenth aspect, wherein the instructions further cause the one or more processors to ramp a set point of the PID controller to a pre-trip value at a ramp-rate after the period of time.

In an eighteenth aspect, a system according to any one of the fifteenth through seventeenth aspects, wherein the upset event is an expander trip.

In a nineteenth aspect, a system according to any one of the fifteenth through eighteenth aspects, wherein the percent opening of the Joule-Thomson valve is further based on a flow-percent open curve.

In a twentieth aspect, a system according to any one of the fifteenth through nineteenth aspects, wherein the percent opening of the Joule-Thomson valve is a function of gas flow through the at least one expander prior to the upset event.

For the purposes of describing and defining the present invention it is noted that the terms "approximately" and "substantially" are utilized herein to represent the inherent degree of uncertainty that may be attributed to any quantitative comparison, value, measurement, or other representation. The terms "approximately" and "substantially" are also utilized herein to represent the degree by which a quantitative representation may vary from a stated reference without resulting in a change in the basic function of the subject matter at issue.

It is noted that recitations herein of a component of the present invention being "configured" in a particular way, "configured" to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

What is claimed is:

1. A method of operating a Joule-Thomson valve of a natural gas production system, the method comprising:

determining an upset event within the natural gas production system;

obtaining a flow rate through at least one expander prior to the upset event;

calculating, based on the flow rate, a percent opening of the Joule-Thomson valve;

opening the Joule-Thomson valve to the percent opening;

controlling the Joule-Thomson valve by a PID controller in a set point tracking mode for a period of time; and controlling the Joule-Thomson valve by the PID controller in an automatic mode after the period of time.

2. The method of claim 1, wherein the period of time is within a range of fifteen seconds and ninety seconds, including endpoints.

3. The method of claim 1, further comprising ramping a set point of the PID controller to a pre-trip value at a ramp-rate after the period of time.

4. The method of claim 1, wherein the upset event is an expander trip.

5. The method of claim 1, wherein the percent opening of the Joule-Thomson valve is further based on a flow-percent open curve.

6. The method of claim 5, wherein the percent opening of the Joule-Thomson valve is a function of gas flow through the at least one expander prior to the upset event.

7. The method of claim 5, wherein the Joule-Thomson valve compensates for a loss of flow through the at least one expander following the upset event.

8. A natural gas production system comprising:

a Joule-Thomson valve;

at least one expander;

one or more processors; and a non-transitory computer-readable medium storing instructions that, when executed by the one or more processors causes the one or more processors to perform the following:

receive an upset event signal corresponding to an upset event within the natural gas production system;

obtain a flow rate through the at least one expander prior to the upset event;

calculate, based on the flow rate, a percent opening of the Joule-Thomson valve;

provide a first control signal to the Joule-Thomson valve to open the Joule-Thomson valve to the percent opening;

provide a second control signal to the Joule-Thomson valve to control the Joule-Thomson valve by a PID controller in a set point tracking mode for a period of time; and provide a third control signal to the Joule-Thomson valve to control the Joule-Thomson valve by the PID controller in an automatic mode after the period of time.

9. The system of claim 8, wherein the period of time is within a range of fifteen seconds and ninety seconds, including endpoints.

10. The system of claim 8, wherein the instructions further cause the one or more processors to ramp a set point of the PID controller to a pre-trip value at a ramp-rate after the period of time.

11. The system of claim 8, wherein the upset event is an expander trip.

12. The system of claim 8, wherein the percent opening of the Joule-Thomson valve is further based on a flow-percent open curve.

13. The system of claim 12, wherein the percent opening of the Joule-Thomson valve is a function of gas flow through the at least one expander prior to the upset event.

14. The system of claim 12, wherein the Joule-Thomson valve compensates for a loss of flow through the at least one expander following the upset event.

15. A system for controlling a natural gas facility, the system comprising:

one or more processors; and a non-transitory computer-readable medium storing instructions that, when executed by the one or more processors causes the one or more processors to perform the following:

receive an upset event signal corresponding to an upset event within the natural gas production system;

obtain a flow rate through at least one expander prior to the upset event;

calculate, based on the flow rate, a percent opening of a Joule-Thomson valve;

provide a first control signal to the Joule-Thomson valve to open the Joule-Thomson valve to the percent opening;

provide a second control signal to the Joule-Thomson valve to control the Joule-Thomson valve by a PID controller in a set point tracking mode for a period of time; and provide a third control signal to the Joule-Thomson valve to control the Joule-Thomson valve by the PID controller in an automatic mode after the period of time.

16. The system of claim 15, wherein the period of time is within a range of fifteen seconds and ninety seconds, including endpoints.

17. The system of claim 15, wherein the instructions further cause the one or more processors to ramp a set point of the PID controller to a pre-trip value at a ramp-rate after the period of time.

18. The system of claim 15, wherein the upset event is an expander trip.

19. The system of claim 15, wherein the percent opening of the Joule-Thomson valve is further based on a flow-percent open curve.

20. The system of claim 15, wherein the percent opening of the Joule-Thomson valve is a function of gas flow through the at least one expander prior to the upset event.

* * * * *